United States Patent [19]

Anderson

[11] Patent Number: 4,732,202

[45] Date of Patent: Mar. 22, 1988

[54] VERTICAL LOUVRE BLIND TRAVELLER

[75] Inventor: Richard N. Anderson, Owensboro, Ky.

[73] Assignee: Hunter Douglas Inc.

[21] Appl. No.: 853,818

[22] Filed: Apr. 18, 1986

[51] Int. Cl.[4] ..... E06B 9/36

[52] U.S. Cl. ..... 160/168.1; 160/177; 160/178.1; 160/900

[58] Field of Search ..... 160/168, 73, 78 R, 178 B, 160/177, 176 B

[56] References Cited

U.S. PATENT DOCUMENTS

| | | | |
|---|---|---|---|
| 3,190,346 | 6/1965 | Arena et al. | 160/172 |
| 3,799,236 | 3/1974 | Debs | 160/168 |
| 4,552,195 | 11/1985 | Dürig et al. | 160/168 R |

FOREIGN PATENT DOCUMENTS

| | | | |
|---|---|---|---|
| 8200515 | 9/1982 | Netherlands | 160/176 R |

*Primary Examiner*—Ramon S. Britts
*Assistant Examiner*—David M. Purol
*Attorney, Agent, or Firm*—Pennie & Edmonds

[57] ABSTRACT

Headrail and traveller assembly for vertical louvre blinds. the travellers are spaced a predetermined distance on opening by a spacer made of thin stainless steel strip. The spacers each have a slot and a hook so the hook of one spacer engages the slot of the next spacer to prevent relative movement beyond a certain point. The traveller is provided with wings which extend forwardly to engage the walls of the headrail to maintain stability. A novel bridle for a lead traveller is also disclosed, The bridle has a spacer portion defining at least one opening. A post extends downwardly from the bottom of the spacer. A loop is formed in the blind pull cord and passed downward through said opening and over said post. The bridle is thereby frictionally engaged on said pull cord.

15 Claims, 17 Drawing Figures

VERTICAL LOUVRE BLIND TRAVELLER

BACKGROUND

1. Field of the Invention

The invention relates to window treatments and in particular to vertical Louvre Blinds and travellers therefor.

2. Related Art

Vertical louvre blinds usually comprise a headrail with several travellers movable along the headrail by one means or another. Each of the travellers has a rotatable hook which holds a vane carrier. The vane carriers in turn hold the vanes or louvres of the blind. The travellers are capable of moving longitudinally along the headrail and imparting rotary movement to the hooks to rotate or tilt the louvres. The rotation is such that all of the louvres are operated simultaneously so that they always extend in planes substantially parallel to one another. Provision is often made to allow the blinds to move slightly if they are inadvertently hit.

The travellers are pulled through the headrail by a cord attached to a lead traveller. As the lead traveller is pulled along the headrail slack is taken up in a spacer means between the lead and second traveller. The spacer means pulls adjacent travellers along at predetermined separations. This provides even spacing between the travellers when extended. When the cord is pulled in the opposite direction the lead traveller moves back towards its adjacent traveller providing slack in the separation means. The lead traveller collides with the second traveller and pushes it along. These travellers continue along to stack each adjacent traveller and pushing all the travellers back to the retracted position.

SUMMARY OF THE PRESENT INVENTION

The Present invention provides a more compact traveller than those previously known. The traveller allows closer stacking of the travellers in the retracted position and a smaller head rail. This provides less dead area which is covered by the louvres when they are fully retracted. Smaller travellers require that a greater number of spacers for the travellers will pass over each traveller in the retracted position. It is therefore an object of the present invention to provide a spacer which stacks in a compact manner thereby allowing the headrail dimensions to be reduced.

The modified form of spacer used in the present invention permits a novel attachment technique. The spacer is made of a thin strip of stainless steel. The strip has a hook like portion which engages a slot in an adjacent spacer when the travellers are extended. On retraction, the hook disengages from the slot and slides on top of the adjacent spacer. The spacers are biased into engagement via a wire spring clip. As the travellers retracted the spacers stack closely one above the other.

The travellers are provided with rollers which roll in a track in the headrail. To maintain the position of the traveller in the headrail, to provide optimum roller operation, two cantilever wings extend forwardly from the traveller to maintain its orientation. The wings diverge slightly to receive the next housing between them in a nested fashion.

The invention further includes a novel form of bridle which permits a headrail to be modified as a center draw headrail. In a center draw headrail, the travellers move from either side of the headrail to the center when they are extended. Because only one lead traveller can be tied to the ends of the closing cord, it is necessary to provide attachment for the bridle of the second lead traveller to an intermediate section of the cord. In the bridle of the present invention a bite or loop is formed in the closing cord. This loop is inserted through an opening in the bridle from above the bridle to below the bridle. The loop is then hooked over a post on the bottom of the bridle. Two sharp corners are provided on either side of the post such that tension on the cord in either direction engages the cord with one of the corners to prevent slipping.

The invention also includes a novel retainer for use with the traveller. The retainer is a wire bent to form a bottom leg having two cantilevered end portions spaced from the bottom leg. The end portions are resilient. One end of the retainer is inserted into an opening which is smaller than the separation of the end portion and bottom leg. This biases the end portion toward the bottom leg so the end portion and bottom leg frictionally engage the opening to hold the retainer in place. The opposite end of the retainer extends over a worm wheel of the traveller and surrounds the spacer. The above described spacers are positioned between the bottom leg and end portions of the retainer. The resilient end portions thereby serve to bias the spacers of two adjacent travellers into face to face contact.

BRIEF DESCRIPTION OF THE DRAWINGS

A detailed description of the invention will now be given with reference to the drawings wherein.

DETAILED DESCRIPTION OF THE PREFERRED EMODIMENT

Figure 1:
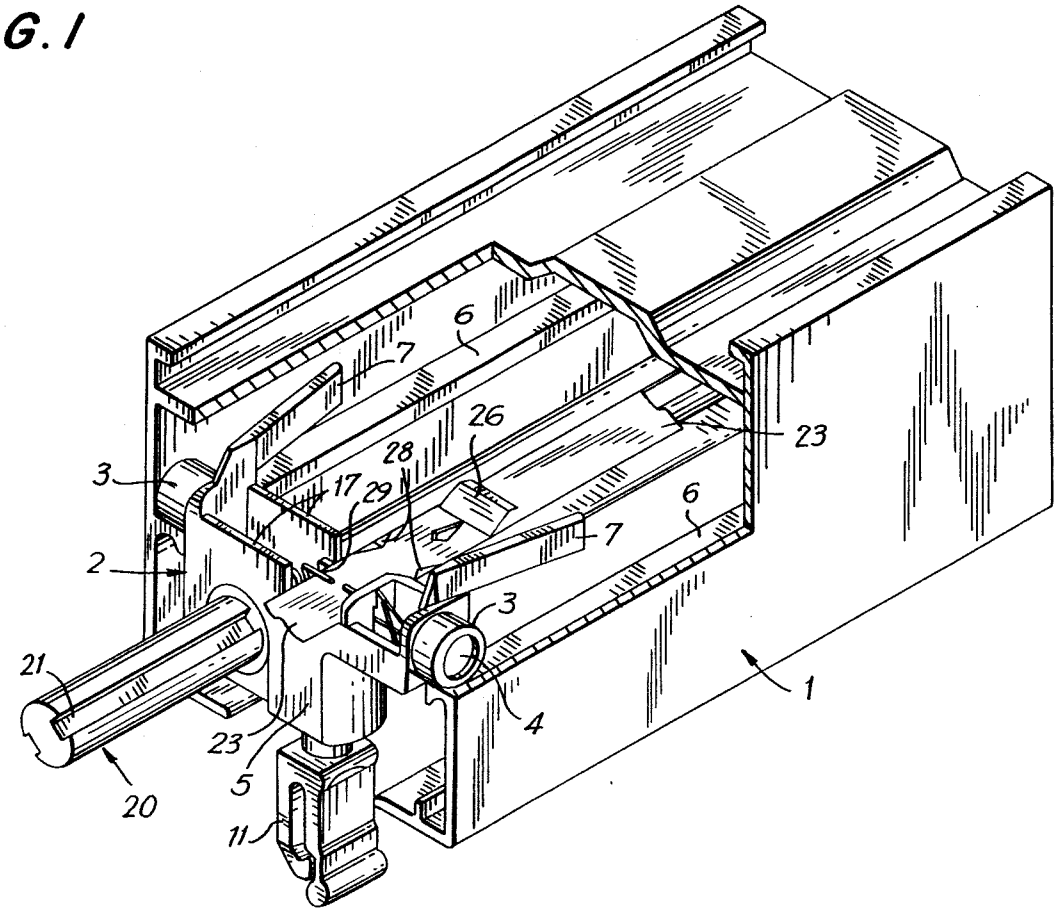
FIG. 1 is a partially cutaway perspective view of the headrail of the invention showing a traveller of the invention.

Referring to FIG. 1 there is shown a headrail 1 having at least one traveller 2 disposed therein. The traveller 2 shown is an intermediate traveller. The lead traveller will be described below in connection with FIGS. 7 and 8. The traveller has a pair of wheels 3 which are mounted on shafts 4 on either side of the traveller housing 5. The wheels ride on ledges 6 formed within the headrail. The wheels 3 provide low friction movement of the traveller 2 within headrail 1. The traveller housing 5 is provided with a pair of cantilevered wings 7 which extend forwardly from the traveller 2, at a slightly diverging angle. The wings 7 engage the walls of the headrail to maintain the proper orientation of the traveller with the headrail so the traveller remains with wheel 3 resting on ledges 6 and therefor prevent cocking of the traveller relative the tilt rod which would increase the friction of motion.

Figure 2:
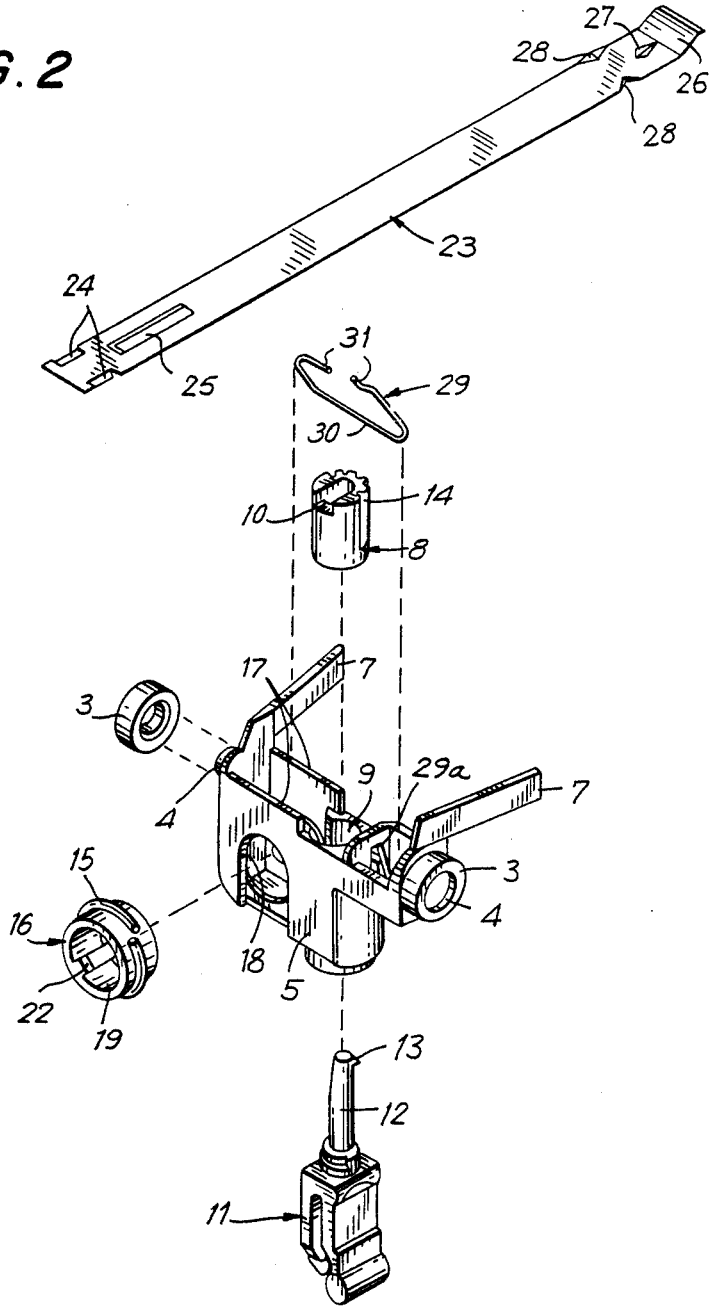
FIG. 2 is an exploded view of the traveller of the invention.

The tilting mechanism for the louvres (not shown) is contained within traveller housing 5 (FIG. 2). A worm wheel 8 is mounted in a known manner in a vertical cylindrical opening 9 in the traveller housing. The worm wheel 8 has an axial passage therethrough and a notch 10 in its side at one end. A slat hook 11 for holding a slat is provided with a shank 12 for insertion into the passageway, of the worm wheel 8. A barb 13 engages in the notch 10 to hold slat hook 11 in position relative the worm wheel 8. Worm wheel 8 is provided with vertical teeth 14 which engage thread 15 of traveller worm 16. Traveller worm 16 is positioned between walls 17 of traveller housing 5. Walls 17 define an opening 18 which is concentric with a central passage 19 of traveller worm 16. Tilt rod 20 is inserted through opening 18 and central passage 19 when traveller worm 16 is in position. The tilt rod has three slots 21 which mate with three ribs 22 extending radially inward of central passage 19 in a known manner. In this way rotation of tilt rod 20 also rotates traveller worm 16. Thread 15 engages teeth 14 of worm wheel 8 and as traveller worm 16 is rotated causes worm wheel 8 to rotate and thereby hook 11. This rotates the louvres of the blind.

Figure 5:
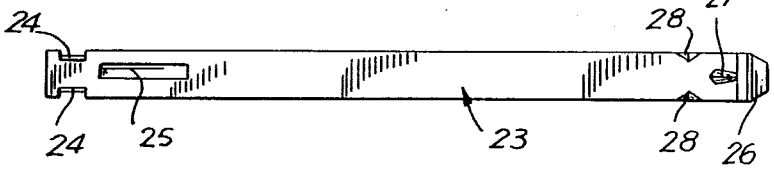
FIG. 5 is a top view of the spacer of the invention.
Figure 6:
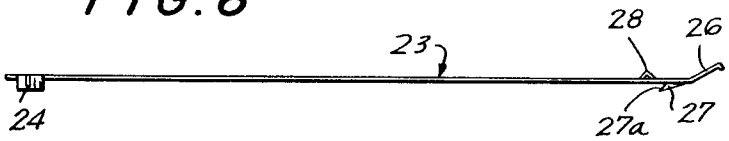
FIG. 6 is a side view of the spacer of FIG. 5.
Figure 3:
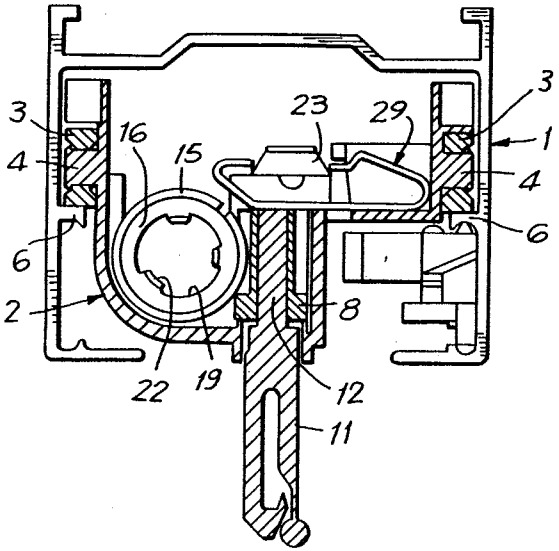
FIG. 3 is a cross-sectional view of the traveller of the invention within a headrail.

A traveller spacer 23 (FIGS. 5 and 6) provides predetermined spacing between adjacent travellers when the travellers are extended. The spacer 23 is an elongated thin piece of stainless steel. Tabs 24 are provided on either side of the spacer near one end. Tabs 24 fit in snug or frictional engagement between walls 17 of traveller housing 5. An Axial slot 25 is formed midway between the side edges of the spacer 23 near the tabs 24. At the opposite end of the spacer 23 is an inclined portion 26 which provides a guide to the end of the spacer as well as providing a back-up hooking force between spacers. A hook extends downwards from the spacer surface. The hook 27 forms a hook edge **27*a* which extends slightly back away from the nearest spacer end. A pair of crimps 28 form bumps which extend upward from the spacer 23. The spacer 23 from a first traveller 2** extends forward from the traveller and overlies the spacer of an adjacent traveller. Each spacer overlies the spacer of the traveller in front of it and is in turn over laid by the spacer of the traveller behind it.

Figure 4:
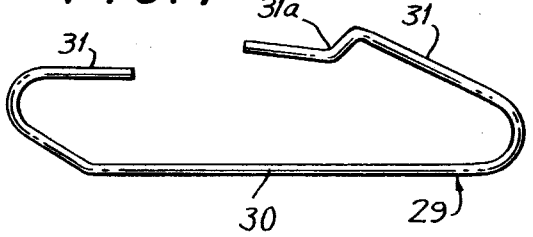
FIG. 4 is an enlarged side view of the retainer clip of the invention.

A wire retainer 29 (FIG. 4) is positioned on each traveller. The retainer 29 has a bottom leg 30 and two top end portions 31. Sandwiched between end portions 31 and the bottom leg 30 is the spacer of the next traveller (that is further from the lead traveller). The retainer wire is formed so the cantilevered end portions 31 may move resiliently. To hold the retainer in position one end is inserted into an opening **29*a* formed in the traveller housing and which is slightly smaller than the separation between the bottom leg 30 and end portion 31 of that end. In this manner bottom leg 30 and end portion 31 frictionally engage the walls of the opening. A lip 31*a* is formed to receive the wall of the opening for positive locking. Once in position, retainer 29 extends above the worm wheel 8** to prevent axial upward movement of the worm wheel.

The spacer of the next traveller slides relative the first traveller. As the first traveller moves away from the next traveller, hook 27 of the spacer of the next traveller slides along the upper surface of the spacer of the first traveller. As the traveller near their predetermined separation, hook 27 of the spacer of the next traveller engages slot 25 of the spacer of the first traveller. At this point end portions 31 of retainer 29 engage the crimps 28 of the spacer of the next traveller. This biases the spacer downward to hold hook 27 within slot 25 as it engages the edge of the slot 25 closest to the tabs 24. This connects the two travellers and they move in unison separated by the distance determined by the position of the hook 27 and slot 25 of the spacers. When the travellers are retracted the hooks 27 of each spacer disengage the slots and permit the spacers to slide relative each other. The spacers merely stack up as the travellers become nested on retraction. The thin spacers permit the angle of the stacked spacers to be small thus reducing the size of the headrail.

Figure 7:
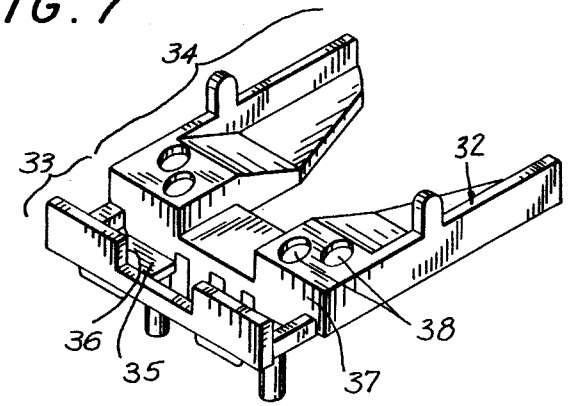
FIG. 7 is a top perspective view of the bridle of the invention.
Figure 8:
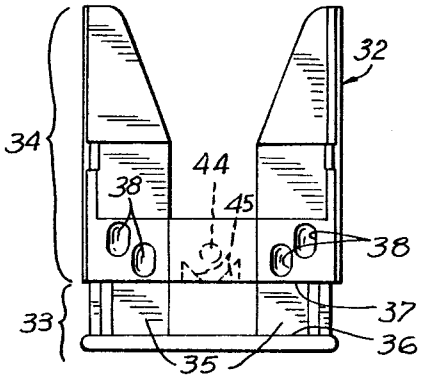
FIG. 8 is a top view of the bridle of FIG. 7.
Figure 10:
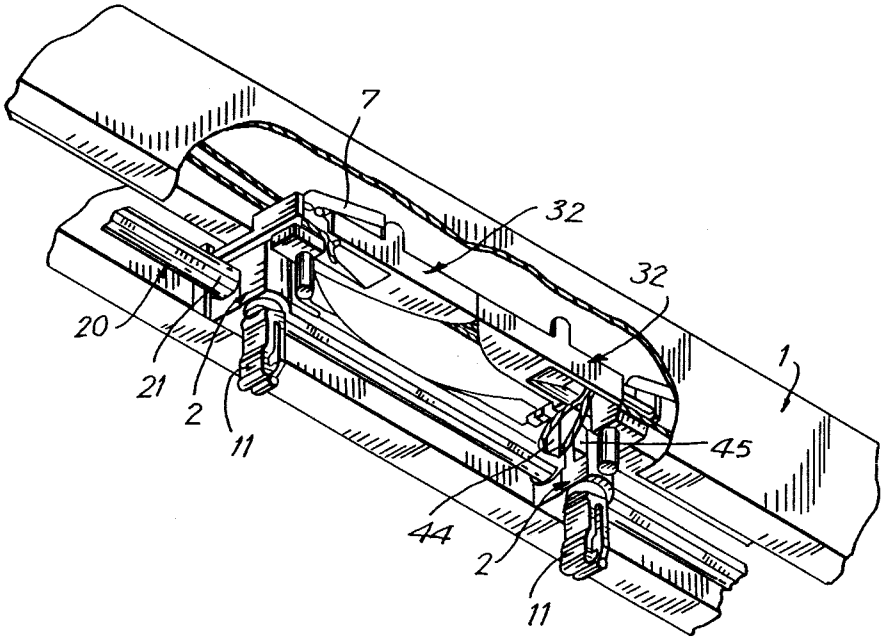
FIG. 10 is a bottom perspective cutaway view of a headrail showing the bridle of FIG. 7.

Referring now to FIGS. 7, 8 and 10 there is shown a bridle 32 for the lead traveller. As mentioned previously the pull cord for the headrail must be attached to the lead traveller. For a left or right pull blind, that is one where all the travellers move in the same direction when opening and in the opposite direction on closing, there is a single lead traveller which is attached to the cord ends. However, in a blind where half the travellers move to one side on opening and the other half move to the other side on opening there are two lead travellers. The bridle 32 of FIGS. 7 and 8 may be used in either situation.

Figure 9:
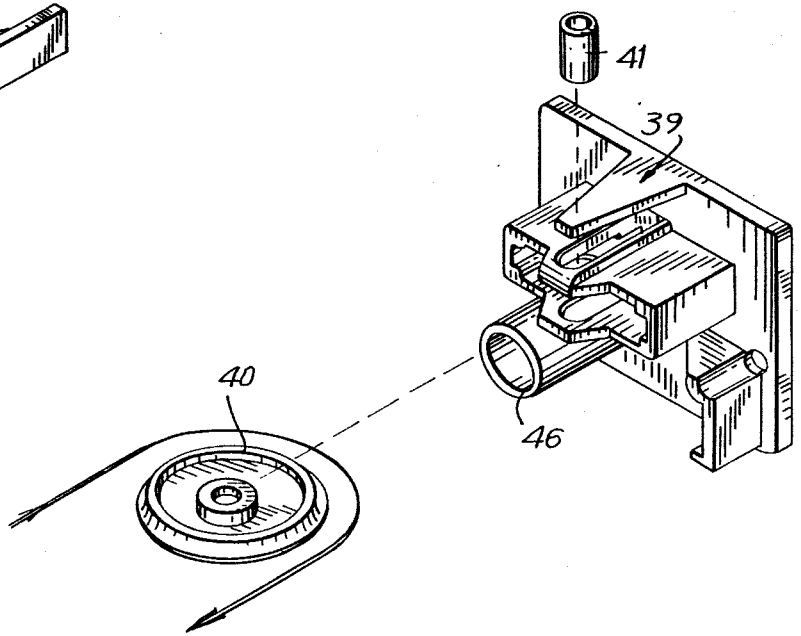
FIG. 9 is an exploded view of a first end cap for the headrail, of the invention.

Bridle 32 has a holding portion 33 and a spacing portion 34. The bridle 32 slides within the headrail 1 and holds the lead traveller in holding portion 33. The traveller rests on support surfaces 35 and is positioned between walls 36 and 37. The pull cord has its ends attached to bridle 32. A first cord end is passed through one of the openings 38 and knotted so the cord end cannot be pulled back through the opening. The cord is then passed through the headrail to end cap 39 (FIG. 9). The cord passes around wheel 40 which is mounted to rotate about shaft 41. The cord then extends the length of the headrail and passes through a second end cap 42 (FIG. 11) along turning surface 43. The cord passes through a cord weight and back through the second end cap along a second turning surface 43. The cord extends back to the bridle, is passed through a second opening 38 and knotted. By pulling on the cord in one direction the lead traveller is moved in a first direction. By pulling the cord in a second direction, the lead traveller is moved in the opposite direction. When the travellers are extended, the lead traveller is pulled through the headrail until spacer portion 34 meets the end cap to stop the traveller and provide predetermining spacing of the traveller from the end cap.

In a center pull blind (FIG. 10) there are two bridles 32. Each of the two lead travellers (the first on one side of center and the second on the opposite side of center of the headrail) is mounted in its bridle so the spacer portions 34 face one another. When the blind is closed the two spacer portions will meet each other and provide proper spacing between the two lead travellers. The first lead traveller is attached to the pull cord as described above. However, the second lead traveller must be attached to the pull cord along the portion which extends through the entire length of the headrail from the first end cap to the second end cap. The novel bridle of the invention permits quick attachment of the bridle and cord. A loop is formed in the cord at the point of attachment. The loop is passed downward through one of the openings 38 and over post 44 which extends downward from the bridle 32. A pair of wedges 45 extend from the bottom of the bridle with their edges directed toward post 44. The wedges 45 each form a sharp edge which positively grips the cord preventing it from slipping around post 44. Thus the bridle 32 of the second lead traveller grips the cord to maintain its position.

Figure 11:
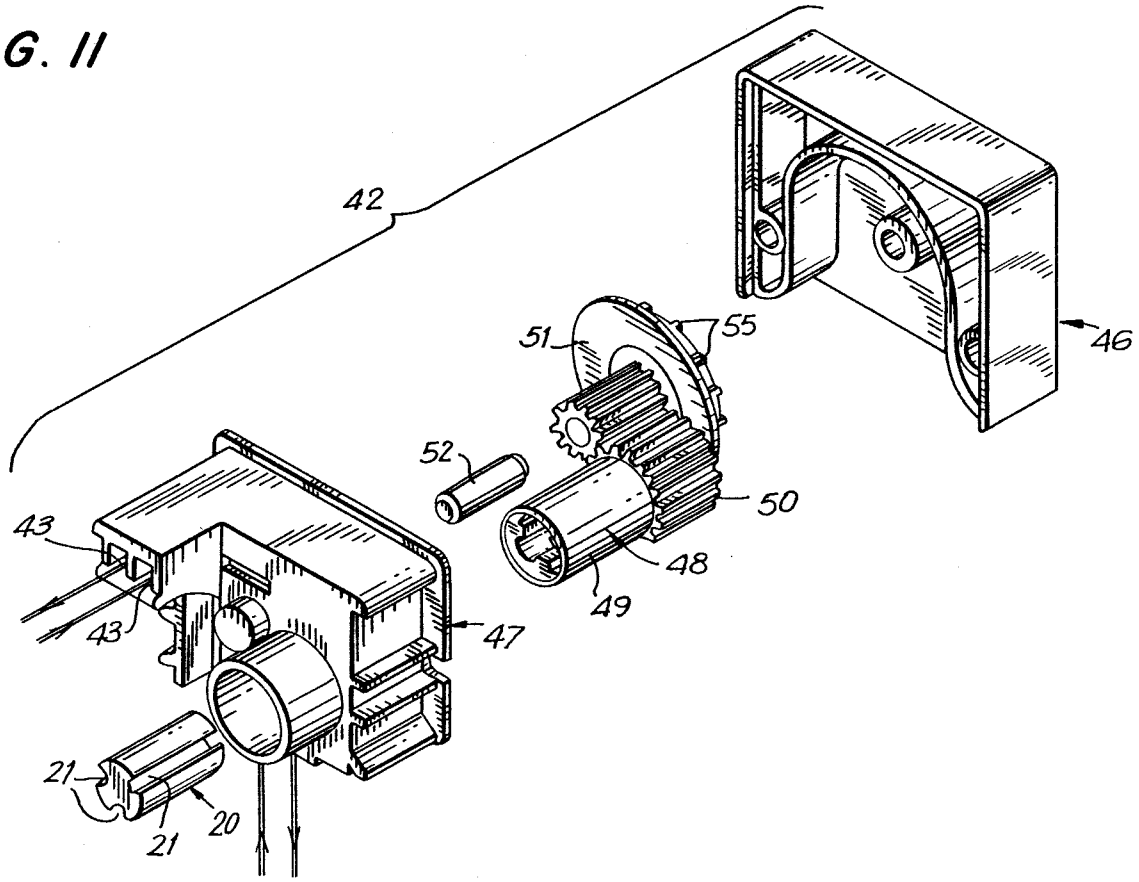
FIG. 11 is an exploded view of the second end cap of the invention showing the tilt rod rotating mechanism.
Figure 15:
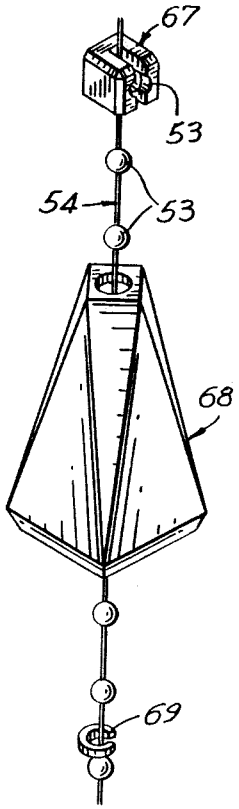
FIG. 15 is a view of the rotator cord tassel with stop.

Referring to FIGS. 9 and 11 there is shown the end caps 39 and 42 of the headrail. The first end cap 39 holds wheel 40 as previously described. A sleeve 46 is formed in the end cap to act as a bearing for one end of tilt rod 20. The tilt rod 20 extends through the travellers to the second end cap 42. The second end cap 42 is comprised of a control cap 46 and a control housing 47. The control housing 47 has turning surfaces 43 for the pull cord which turn the cord at a right angle and out the bottom of the control housing. The tilt rod 20 extends through an opening in control housing 47 and carries a tilt gear 48 on its end. The tilt gear 48 has a sleeve 49 at one end with radially inwardly extending ribs so the tilt gear 48 can be mounted on the end of the tilt road 20. The ribs engage slots 21 so the tilt gear 48 does not rotate relative to tilt road 20. The end of tilt gear 48 opposite sleeve 49 is gear 50. Gear 50 engages tilt drive 51 which is mounted for rotation on axle 52. Axle 52 is mounted between control cap 46 and control housing 48. One end of tilt drive 51 has circumferentially disposed teeth 55 which engage beads 53 of tilt chain 54 (FIG. 15). Tilt chain 54 passes around the teeth 55 so pulling on tilt chain 54 will cause rotation of tilt drive 51. Rotation of tilt drive 51 causes rotation of tilt gear 48 and thereby tilt rod 20. Thus the louvres are rotated as previously described.

Figure 12:
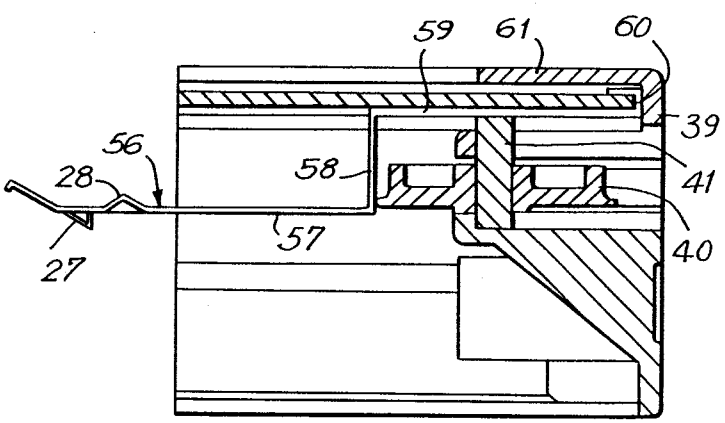
FIG. 12 is a cross-sectional view of a portion of a headrail the end cap of FIG. 9 and the end spacer of the invention.
Figure 13:
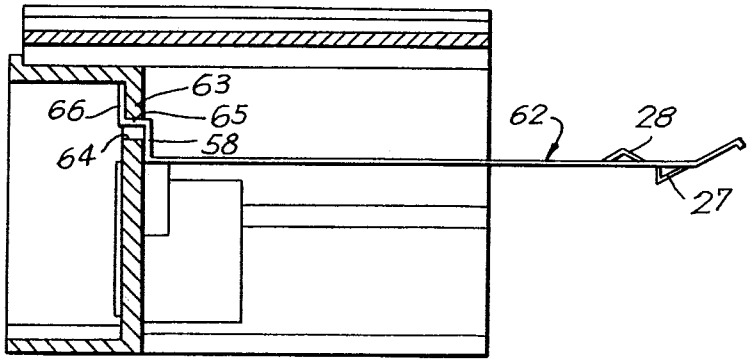
FIG. 13 is a cross-sectional view of a portion of a headrail, the end cap of FIG. 11 and an end spacer of the invention.

Referring now to FIGS. 12 and 13 there are shown end spacers for spacing the end traveller from the end of the headrail. The end spacers operate in the same manner as the spacers described above, but are fixed to the end caps. End spacer 56 is mounted to end cap 39. The end spacer 56 has an axially extending portion 57 similar to the spacers described above. Axially extending portion has hook 27 and crimps 28. Axially extending portion 57 is supported by perpendicular portion 58. Perpendicular portion 58 extends between the inner top surface of the headrail and axialy extending portion 57. Perpendicular portion 58 is held in position by contact portion 59. Contact portion extends in face-to-face contact with the top inner surface of the headrail between the perpendicular portion 58 and the end of the headrail. Contact portion 59 passes through an opening defined on three sides by a notch in end cap 39 and on a fourth side by the top inner surface of the headrail. Contact portion 59 terminates in a u-shaped holding portion 60 which receives and grips the headrail top. End cap 39 is modified with an extension 61 which overlays the holding portion 60 to sandwich it between extension 61 and holding portion 60.

The end spacer 62 of FIG. 13 is used in connection with end cap 42. The spacer has axially extending portion 57 as described above, however perpendicular portion 58 extends in face to face contact with an inner end wall 63 of end cap 42. An opening 64 is defined by end wall 63. A connecting portion 65 extends parallel to axially extending portion 57 and passes through opening 64 connecting perpendicular portion 58 with backing portion 66 which extends in face to face contact with the surface of end wall 63 on the opposite side from perpendicular portion 58*a*.

Each of these end spacers 56 and 62 easily formed by bending a piece of stainless steel strip. The end spacers may quickly be inserted into the blind assembly by attaching holding portion of spacer 56 60 to the headrail prior to insertion of end cap 39 or (when space for 62 is used) inserting backing portion 66 through opening 64 in end cap 42 to seat connecting portion 65 in the opening.

As shown in FIG. 15 the tilt chain 54 is provided with a u-shaped stop 67. Stop 67 receives and holds on bead 53. When the chain is pulled such that it moves the stop toward the headrail, movement will end when the stop meets the headrail. Tassle 68 is provided at the end of chain 54. The tassle has the shape of a cone or pyramid with a circular opening at its pinacle. The opening is large enough to permit passage of beads 53 through the opening. However, ring 69 is mounted on the chain. Ring 69 has an opening large enough to receive the cord between beads without permitting passage of the beads 53. The ring 69 is large enough to prevent its passage through the opening at the top of the tassle. Thus, the tassle is mounted on the cord. Ring 69 has a split opening smaller than the cord so the opening may be expanded to snap the ring around the cord.

Figure 14:
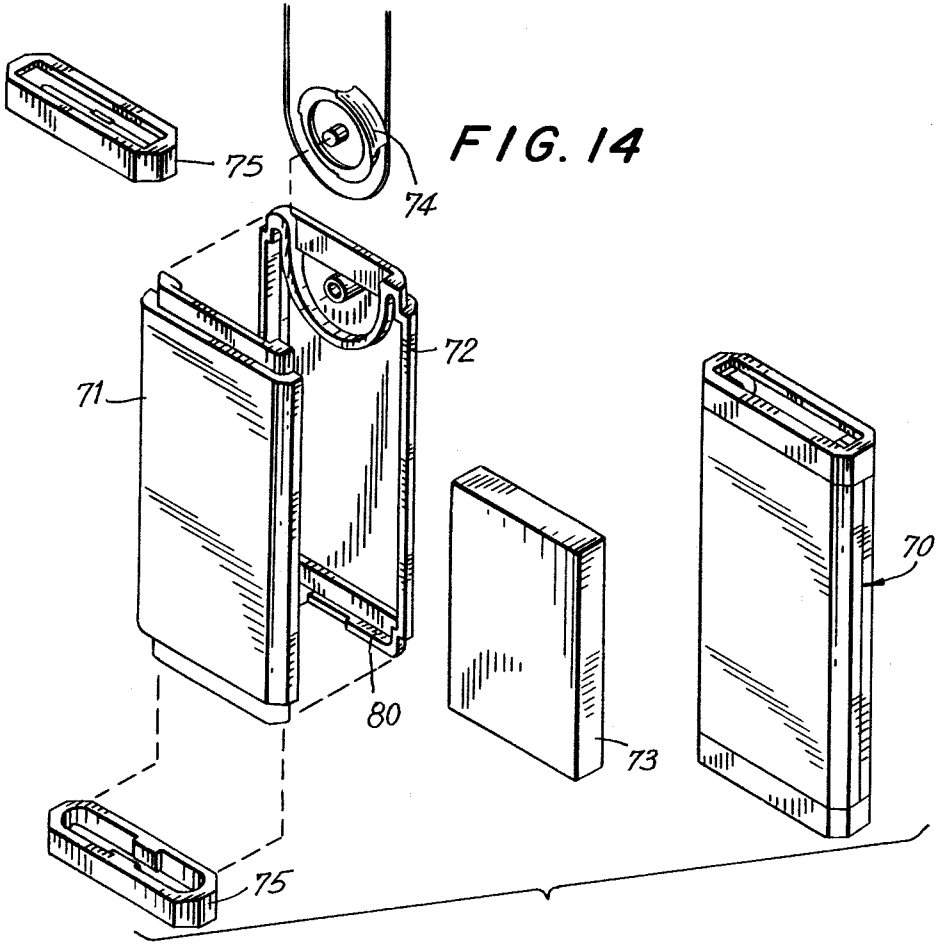
FIG. 14 is an exploded view of the pull cord weight of the invention.

Shown in FIG. 14 is the pull cord weight. The pull cord passes downward from second end cap 42 forming a large loop and returns to the second end cap to keep the cord hanging straight a pull cord weight is mounted thereon. The pull cord weight 70 comprises a two piece housing 71 and 72 which carries a ballast 73 and pulley 74 therein the pull cord passes around pulley 74 which is mounted for rotation. Two end collar pieces 75 snap onto the housing to hold it together.

Figure 16:
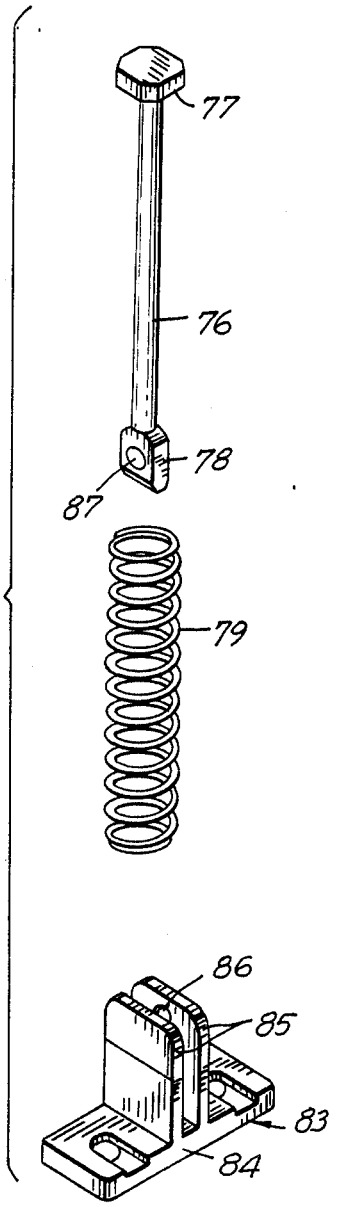
FIG. 16 is an exploded view of the shaft, spring and mounting bracket for spring biasing the cord weight of FIG. 17.
Figure 17:
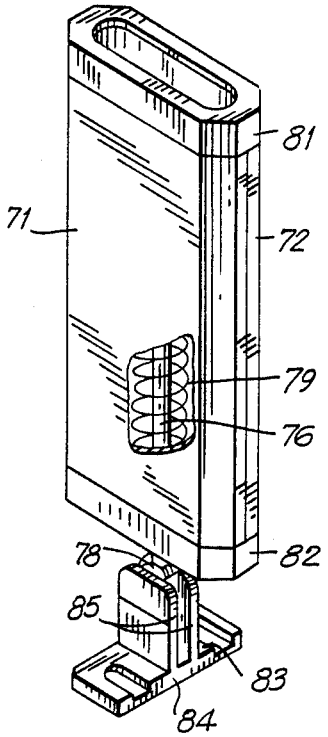
FIG. 17 is a cutaway view of the spring biased cord weight of the invention.

FIGS. 16 and 17 show a modified tensioning means of the invention. The tensioning means has a biasing mechanism (FIG. 16) for taking up slack in the pull cord. The device includes a shaft 76 having a spring stop 77 at one end and a pladdle 78 at the opposite end. A spring 79 surrounds the shaft and abutts the spring stop 77 at one end. The shaft communicates with the inner chamber of the housing 71 and 72. A pulley (not shown) is rotatably disposed in the housing as described above in connection with FIG. 14. The front half 71 and back half 72 of the housing each have an inwardly extending ledge 80. The shaft 76 is inserted into the spring 79 and then positioned within the housing so the second end of the spring abutts ledge 80 when the front and back halves 71 and 72 are joined. The paddle 78 extends out of the housing 71 and 72. A top collar 81 is positioned at a first end of the housing to hold the front and back halves in maring relation at that end. A bottom collar 82 similarly holds the opposite ends in mating relation. The paddle 78 is inserted into a bracket 83 having a base 84 and two spaced parallel wall 85 extending perpendicularly therefrom. The wall 85 face one another and are each provided with a protuberance 86 on their facing surfaces. The protuberances 86 are received in dimples 87 on the paddle and thereby hold the paddle 78 to the bracket. The tensioning means and pull cord is adjusted so the spring 79 is slightly compressed in the normal position. Any slack or togging on the pull cord is taken up by relative movement between housing 71, 72 and shaft 76. The spring biases the shaft into the housing to provide tension to the pull cord.

I claim:

1. A spacer for use with travellers of a vertically louvred blind assembly of the type having a plurality of travellers for holding the vertical louvres, said spacer permitting two adjacent travellers to move apart until said travellers reach a predetermined separation and preventing further separation of said travellers beyond said predetermined distance but permitting said travellers to move toward each other unrestrained, comprising:

(a) a first elongated strip extending from a first of said travellers in a direction parallel to said headrail to slidably overlay a second elongated strip extending in the same direction from an adjacent traveller;

(b) a slot formed in said second strip and having an elongated dimension parallel to the elongated dimension of said second strip;

(c) hook means extending downward from said first strip to side along the surface of said second strip and engage an edge of said slot when said first and second travellers are moved to a predetermined separation distance to prevent further relative movement of said first and second strips and thereby preventing further separation of said first and second travellers beyond said predetermined distance;

(d) resilient spring means for biasing said first elongated strip into contact with said second strip.

2. The spacer according to claim 1 wherein:

(a) at lesat one crimp is formed in said first strip to provide a raised bump on said first strip, said crimp being positioned on said first strip to move beneath said spring means as said hook means nears the edge of said slot to thereby increase the force biasing said first strip.

3. The spacer according to claim 2 wherein:

(a) said first strip has a pair of downwardly extending tabs for positioning in snug fit between spaced walls of said traveller and thereby fix said strip to said traveller.

4. The spacer according to claim 3 wherein:

(a) a wire retainer is provided in said traveller and at least a portion of said retainer extends above and engages said first or second to hold said first and second strips to face-to-face contact.

5. A traveller and retainer for positioning in a housing of the traveller to retain a gear wheel in said housing for use in a vertical louvred blind comprising:

(a) a wire form having a bottom leg and curved portion at opposite ends of said bottom leg which curve back to form two upper cantilevered end portions of wire;

(b) a gear wheel positioned in an opening defined by said housing, said opening having a vertical axis;

(c) a wall of said housing defining a horizontal opening for receiving one end of said retainer, said opening sized smaller than the separation between a first of said cantilevered ends and the bottom leg to cause biasing of said first cantilevered end toward said bottom leg and said bottom leg with the edge of said opening, said bottom leg extending out of said opening and above said gear wheel to obstruct the movement of the gear wheel in an upward axial direction.

6. The traveller and retainer according to claim 5 wherein:

(a) A lip portion is provided in said first cantilevered end portion to seats against a back of the wall defining said horizontal opening and thereby prevent withdrawal of the retainer.

7. The traveller and retainer according to claim 5 wherein:

(a) a spacer means is provided on said traveller which includes an elongated strip which is in face to face engagement with a similar strip of an adjacent traveller; and (b) the cantilevered ends of said retainer are positioned above said strip and similar strip and hold said strip and similar strip into face to face engagement.

8. A spacer for preventing movement of a traveller in a headrail of a vertical louvre blind beyond a predetermined distance from the end of the headrail comprising:

(a) a thin elongated spacer strip extending axially in said headrail;

(b) a hooking means at a first end of said spacer strip for engaging and holding said traveller against movement beyond a predetermined distance from said end; and (c) a second end of said spacer strip fixed to an end cap of said headrail to secure said spacer strip in said headrail.

9. A spacer for preventing movement of a traveller in a headrail of a vertical louvre blind beyond a predetermined distance from an end of the headrail comprising:

(a) a thin elongated spacer strip extending axially in said headrail;

(b) a hooking means at a first end of said spacer strip for engaging and holding said traveller against movement beyond a predetermined distance from said end;

(c) a second end of said spacer strip having a U-shape; and (d) an end cap for closing said end, said end cap extending over said U-shape at said second end to sandwich said second end between said wall and said end cap.

10. A traveller for a vertical louvre blind assembly of the type having a plurality of travellers moving in the longitudinal direction of the blind headrail and for holding vertical louvres, said traveller including a traveller housing, comprising at least two wings cantilevered to extend from the housing in a direction of traveller movement and engagable with the inside of the headrail to stabilize the position of said traveller housing with respect to said headrail, each wing extending beyond the traveller housing by an amount substantially greater than the axial length of the housing, and having an inclined position with respect to the longitudinal axis of the headrail in the mounted position of the traveller.

11. A traveller according to claim 10 wherein the wings are positioned at or adjacent the top of said traveller housing, so as to be engagable, when used in an inverted U-shaped channel section headrail, with the web of the U.

12. A traveller according to claim 10 wherein the wings are at the same axial end of the housing and diverge with respect to one another.

13. A traveller according to claim 10 wherein the axial length of the traveller housing is no greater than seven and one-half millimeters.

14. A traveller according to claim 10 wherein the wings are resilient.

15. A traveller according to claim 10, and further comprising gear means for rotating/tilting said louvres and wherein the housing includes a bridge therein defining a horizontal opening therebelow, wherein the traveller further includes a spring wire retainer including a lower leg and two upper arms cantilevered one from each end of said lower leg to extend towards one another substantially parallel thereto, wherein one of said upper arms is engaged under said bridge to be retained thereby and wherein said lower leg extends over the gear means or a part thereof to obstruct upward movement thereof.

* * * * *